US008792795B2

(12) United States Patent
Murayama

(10) Patent No.: US 8,792,795 B2
(45) Date of Patent: Jul. 29, 2014

(54) IMAGE FORMING APPARATUS THAT FORMS AND SENSES MARKS AND METHOD FOR CONTROLLING IMAGE FORMING APPARATUS

(75) Inventor: Kentaro Murayama, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 121 days.

(21) Appl. No.: 13/333,271

(22) Filed: Dec. 21, 2011

(65) Prior Publication Data

US 2012/0163849 A1 Jun. 28, 2012

(30) Foreign Application Priority Data

Dec. 24, 2010 (JP) ..... 2010-287445
Nov. 14, 2011 (JP) ..... 2011-248151

(51) Int. Cl.

| | |
|---|---|
| ***G03G 15/08*** | (2006.01) |
| ***G03G 21/00*** | (2006.01) |
| ***G03G 15/16*** | (2006.01) |
| ***G03G 15/01*** | (2006.01) |

(52) U.S. Cl.

CPC ..... *G03G 15/161* (2013.01); *G03G 21/0005* (2013.01); *G03G 15/0189* (2013.01)

USPC ..... 399/29

(58) Field of Classification Search

USPC ..... 399/49, 301, 29

See application file for complete search history.

(56) References Cited

U.S. PATENT DOCUMENTS

| | | | |
|---|---|---|---|
| 2006/0140685 | A1 | 6/2006 | Muroi |
| 2008/0031649 | A1 | 2/2008 | Dan |
| 2008/0124114 | A1 | 5/2008 | Yamagata et al. |
| 2012/0163842 | A1 | 6/2012 | Murayama |

FOREIGN PATENT DOCUMENTS

| | | | |
|---|---|---|---|
| JP | 2001-100614 | A | 4/2001 |
| JP | 2001-356570 | A | 12/2001 |
| JP | 2004-069909 | A | 3/2004 |
| JP | 2005-309050 | A | 11/2005 |
| JP | 2006-178374 | A | 7/2006 |
| JP | 2008-039905 | A | 2/2008 |
| JP | 2008-134333 | A | 6/2008 |
| JP | 2008-158459 | A | 7/2008 |

OTHER PUBLICATIONS

Machine translation of JP 2001-356570.*

Japan Patent Office, Notice of Reasons for Rejection for Japanese Patent Application No. 2011-248151 (counterpart Japanese patent application), mailed Jan. 22, 2013.

State Intellectual Property Office of the People'S Republic of China, Notification of First Office Action for Chinese Patent Application No. 201110431568.5 (related to above-captioned patent application), mailed Jan. 23, 2014.

* cited by examiner

*Primary Examiner* — Walter L Lindsay, Jr.
*Assistant Examiner* — Barnabas Fekete
(74) *Attorney, Agent, or Firm* — Baker Botts L.L.P.

(57) ABSTRACT

In an image forming apparatus, developer remaining on a photosensitive member as transfer residual developer is caught temporarily by a catching portion. In a collecting process, the transfer residual developer caught by the catching portion is returned to the photosensitive member, the transfer residual developer then is transferred onto a conveyor member, and the transfer residual developer is collected by a collecting portion. In the collecting process, the presence or absence or an amount of the transfer residual developer transferred onto the conveyor member is measured.

21 Claims, 10 Drawing Sheets

IMAGE FORMING APPARATUS THAT FORMS AND SENSES MARKS AND METHOD FOR CONTROLLING IMAGE FORMING APPARATUS

CROSS-REFERENCE TO RELATED APPLICATION

This application claims priority from Japanese Patent Application No. 2010-287445, filed on Dec. 24, 2010 and Japanese Patent Application No. 2011-248151, filed on Nov. 14, 2011, which are incorporated herein by reference.

BACKGROUND OF THE INVENTION

1. Field of the Invention

The invention relates to image forming apparatus that form a developer image onto a photosensitive member and transfer the developer image onto a conveyor member from the photosensitive member and to methods for controlling image forming apparatus.

2. Description of Related Art

A known electrophotographic image forming apparatus forms a toner image onto a photosensitive member and transfers the toner image onto a sheet from the photosensitive member. Another known electrophotographic image forming apparatus forms a toner image onto a photosensitive member, transfers the toner image onto a belt, and then transfers the toner image from the belt onto a sheet. In the electrophotographic image forming apparatuses, toner remains on the photosensitive member after transfer of the toner image therefrom. The toner remaining on the photosensitive member is referred to as "transfer residual toner."

In a known technique for catching and collecting the transfer residual toner from the photosensitive member, an image forming apparatus includes a photosensitive member cleaner, which catches matter adhering to a photosensitive member, and a belt cleaner, which collects matter adhering to a belt. The photosensitive member cleaner temporarily catches transfer residual toner adhering to the photosensitive member, and then re-provides the transfer residual toner to the photosensitive member at a predetermined timing. The photosensitive member next transfers the transfer residual toner onto the belt. The toner transferred onto the belt by the photosensitive member also is referred to as "transfer residual toner." The belt cleaner then collects the transfer residual toner from the belt.

SUMMARY OF THE INVENTION

Nevertheless, problems may arise in the known image forming apparatus. Although the transfer residual toner may be caught temporarily by the photosensitive member cleaner and eventually may be collected by the belt cleaner, an amount of, or even the presence or absence of, transfer residual toner discharged during a single discharge operation of the photosensitive member cleaner may not be determinable. The embodiments of the invention described herein may address the problems which may arise in the known image forming apparatus.

The invention was made to solve the problem that has arisen in the known image forming apparatus. An embodiment provides for an image forming apparatus in which an amount or the presence or absence of transfer residual developer temporarily caught may be determined.

An image forming apparatus disclosed herein may comprise a conveyor member, a process unit, and a controller. The process unit may comprise a photosensitive member, an image forming portion, a transfer member, and a catching portion. The image forming portion may be configured to form a developer image with a developer on the photosensitive member. The transfer member may be configured to transfer the developer image formed on the photosensitive member onto the conveyor member, wherein the developer remaining on the photosensitive member after transferring the developer image from the photosensitive member may be transfer residual developer. The catching portion may be configured to catch the transfer residual developer from the photosensitive member and to return the transfer residual developer caught by the catching portion to the photosensitive member. The transfer member may be configured to transfer the transfer residual developer returned to the photosensitive member from the catching portion onto the conveyor member. The controller may be configured to determine whether the transfer residual developer is present or absent on a surface of the conveyor member using a sensor.

An image forming apparatus disclosed herein may comprise a conveyor member, a process unit, and a controller. The process unit may comprise a photosensitive member, an image forming portion, a transfer member, and a catching portion. The image forming portion may be configured to form a developer image with a developer on the photosensitive member. The transfer member may be configured to transfer the developer image formed on the photosensitive member onto the conveyor member, wherein the developer remaining on the photosensitive member after transferring the developer image from the photosensitive member may be transfer residual developer. The catching portion may be configured to catch the transfer residual developer from the photosensitive member and to return the transfer residual developer caught by the catching portion to the photosensitive member. The transfer member may be configured to transfer the transfer residual developer returned to the photosensitive member from the catching portion onto the conveyor member. The controller may be configured to determine an amount of the transfer residual developer on a surface of the conveyor member using a sensor.

A method for controlling an image forming apparatus disclosed herein may comprise steps for controlling the image forming apparatus. The image forming apparatus may comprise a conveyor member, a sensor, and a process unit. The process unit may comprise a photosensitive member. The method may comprise a step of forming a developer image with a developer on the photosensitive member. The method may comprise a step of transferring the developer image formed on the photosensitive member onto the conveyor member, wherein the developer remaining on the photosensitive member after transferring the developer image from the photosensitive member is transfer residual developer. The method may comprise a step of transferring the transfer residual developer remaining on the photosensitive member onto the conveyor member. The method may comprise a step of determining whether the transfer residual developer is present or absent on a surface of the conveyor member using the sensor.

In the image forming apparatus disclosed herein, the catching portion may catch temporarily the transfer residual developer on the photosensitive member. The transfer residual developer then is supplied back to the photosensitive member, and is transferred onto the conveyor member. After that, a collecting portion may collect the transfer residual developer on the conveyor member. In the collecting process, an amount of the transfer residual developer transferred onto the conveyor member may be determined. For example, the presence or absence of transfer residual developer or an amount of transfer residual developer may be determined. The measurement of the transfer residual developer may be performed each time when the collecting process is performed or only when predetermined criteria are met at the time of the collecting process. The criteria may be that the number of pages printed from the previous collecting process is greater than or equal to a threshold value, a time elapsed from the previous collecting process exceeds a threshold time, or an amount of developer used since the previous collecting process greater than or equal to a predetermined value.

Thus, in the image forming apparatus, the presence or absence or an amount of transfer residual developer that the catching portion has discharged and the collecting portion has not collected may be determined in the collecting process. By doing so, a condition of transfer residual toner may be estimated. As a result of the estimation, for example, a deterioration level of the developer or amount of developer stored in the collecting portion may be estimated.

In the image forming apparatus, the controller may determine whether the developer is deteriorated based on the presence or absence or an amount of transfer residual developer. The charging control of toner as the developer may become difficult due to progress of toner deterioration and an amount of transfer residual toner may vary. Thus, it may be estimated that when a difference between an actual amount of transfer residual toner and an ideal amount of transfer residual toner has increased, the toner deterioration is more advanced. Accordingly, it may be recommended that the toner deterioration level be determined based on the presence or absence or an amount of transfer residual developer.

In the image forming apparatus, the controller may determine whether the developer is deteriorated based on an amount of developer used for the developer image formed by the image forming portion and an amount of transfer residual developer. Because the amount of transfer residual developer varies depending on contents of images, it may be preferable to consider the amount of used developer.

In the image forming apparatus, the controller may determine whether the developer is deteriorated based on the presence or absence or the amount of transfer residual developer when a special pattern image is formed by the image forming portion and then is transferred onto the conveyor member. The deterioration level of the developer may be determined with higher accuracy by the accuracy with which the special pattern image is newly formed, and the amount of transfer residual developer of the pattern image is detected.

In the image forming apparatus, the controller may change image formation criteria based on the presence or absence or an amount of transfer residual developer. As described above, the deterioration level of toner as the developer may be estimated based on the amount of transfer residual developer. By reviewing the image formation criteria based on the presence or absence or an amount of transfer residual developer, deterioration of images may be reduced or prevented. When the toner is deteriorated, the image formation criteria may be changed. For example, a bias for developing may be increased to more readily charge toner, a bias for transfer may be increased to more readily transfer a toner image, or exposure intensity may be increased to more readily perform the development.

In the image forming apparatus, the controller may change the image formation criteria based on an amount of developer used for the developer image formed by the image forming portion and an amount of transfer residual developer. Because the amount of transfer residual developer varies depending on contents of images, it may be preferable to give consideration to the amount of used developer.

In the image forming apparatus, the controller may change the image formation criteria based on the presence or absence or the amount of transfer residual developer when a special pattern image is formed by the image forming portion and then is transferred onto the conveyor member. The deterioration level of the developer may be determined with higher accuracy by the accuracy with which the special pattern image is newly formed, and the amount of transfer residual developer of the pattern image is detected.

In the image forming apparatus, the controller may estimate an amount of transfer residual developer collected by the collecting portion based on the presence or absence or an amount of transfer residual developer. By doing so, a user may be notified of the amount of transfer residual developer stored in the collecting portion. For example, the user may be notified that the collecting portion is full of developer.

The image forming apparatus further may comprise a plurality of process units with respect to the conveyor member, and each of the process units may comprise the photosensitive member and the image forming portion. In the image forming apparatus, the controller may control a timing, at which the transfer residual developers are provided back to the respective photosensitive members from the catching portions, to keep the transfer residual developers from overlapping when transferred onto the conveyor member from the process units. With this structure, the amount of transfer residual developer may be accurately determined on a process-unit basis.

In the image forming apparatus, the controller may start and end an operation to provide the transfer residual developer back to the photosensitive member from the catching portion at the same time in all of the process units. With this structure, the operation may be controlled by a common circuit, and, thus, the process may be made less complicated.

In the image forming apparatus, the controller may read a mark which is an image for adjustment of at least one of positional deviation and developer-density deviation when determining the presence or absence or an amount of transfer residual developer. A sensor also may have a function of reading a mark for adjustment of positional deviation or developer-density deviation. Consequently, the transfer residual developer may be measured without increasing the components of the image forming apparatus.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION OF EMBODIMENTS OF THE INVENTION

Embodiments in which an image forming apparatus and an image forming system according to the invention are implemented now are described in detail with reference to the accompanying drawings, like numerals being used for like corresponding parts in the various drawings. In the embodiment, the invention may be applied to a multifunction peripheral device ("MFP") having a color printing function.

Figure 1:
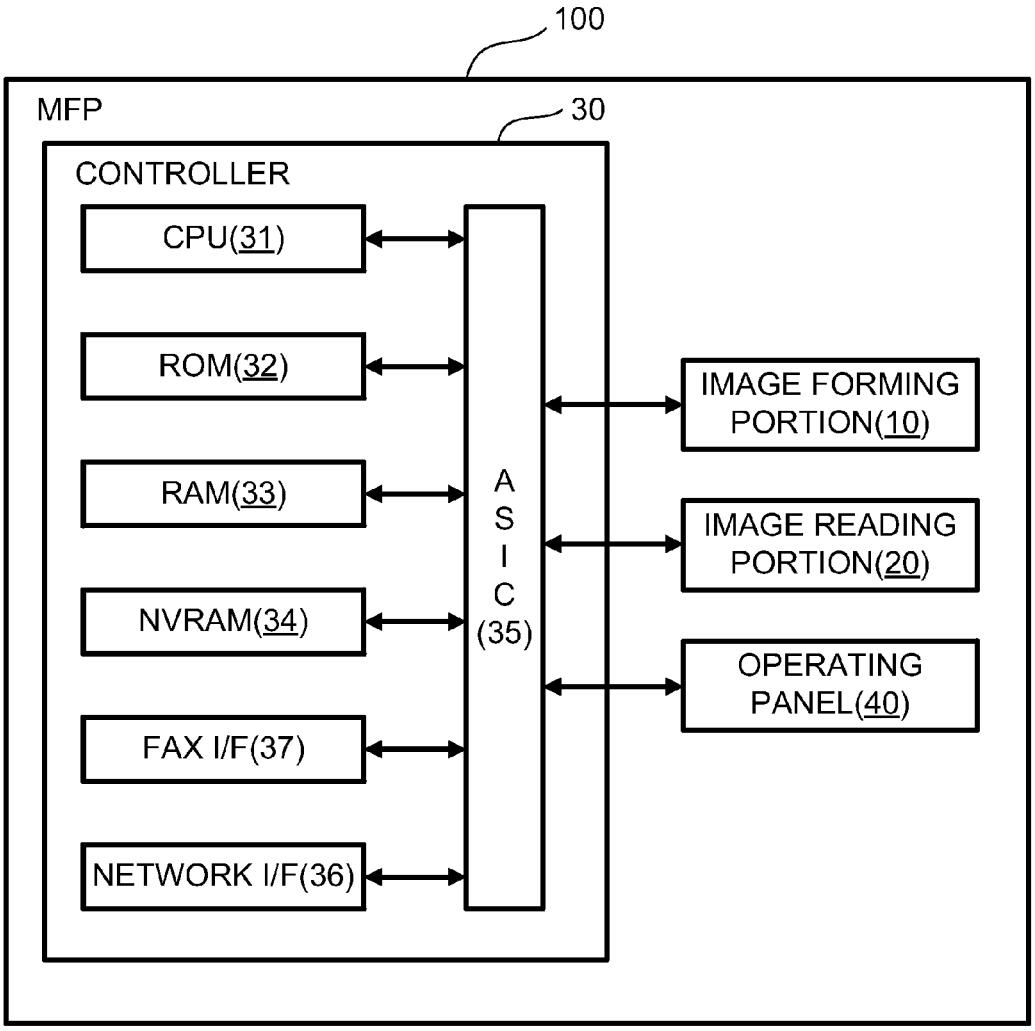
FIG. 1 is a block diagram depicting an electric configuration of a multifunction peripheral device in an embodiment according to one or more aspects of the invention.

As depicted in FIG. 1, an MFP 100 may comprise a controller 30 that may comprise a central processing unit ("CPU") 31, a read-only memory ("ROM") 32, a random-access memory ("RAM") 33, a nonvolatile random-access memory ("NVRAM") 34, an application-specific integrated circuit ("ASIC") 35, a network interface ("I/F") 36, and a facsimile ("FAX") interface 37. Controller 30 may be electrically connected with an image forming portion 10, an image reading portion 20, and an operating panel 40. Image forming portion 10 may be configured to form an image onto a sheet. Image reading portion 20 may be configured to read an image from a document. Operating panel 40 may be configured to display operating statuses and to accept a user's input operation.

CPU 31 may serve as a control center and may be configured to perform computations for accomplishing various functions, e.g., an image reading function, an image forming function, a facsimile data transmitting/receiving function, and a cleaning function (described below), which may be performed in MFP 100. ROM 32 may store various control programs and settings for controlling MFP 100 as well as certain initial values. RAM 33 may be used as a workspace for temporarily storing the control programs read from ROM 32 or as a storage area for temporarily storing image data. NVRAM 34 may be used as a storage area for storing various settings and image data.

CPU 31 may control functions of each component or each portion of MFP 100 (e.g., a timing at which an exposure device, that constitutes image forming portion 10, irradiates light, and a timing at which drive motors for rollers constituting a sheet-conveying path are driven and stopped) via ASIC 35. Further, CPU 31 stores processing results in RAM 33 or NVRAM 34, in accordance with the control programs read from ROM 32 and signals sent from sensors 61.

Network interface 36 may be connected with a network that may allow MFP 100 to connect with another information processing device. FAX interface 37 may be connected with a telephone line that may allow MFP 100 to connect with a facsimile machine at another end of the telephone line. MFP 100 may perform data communications with external devices via network interface 36 or FAX interface 37.

Figure 2:
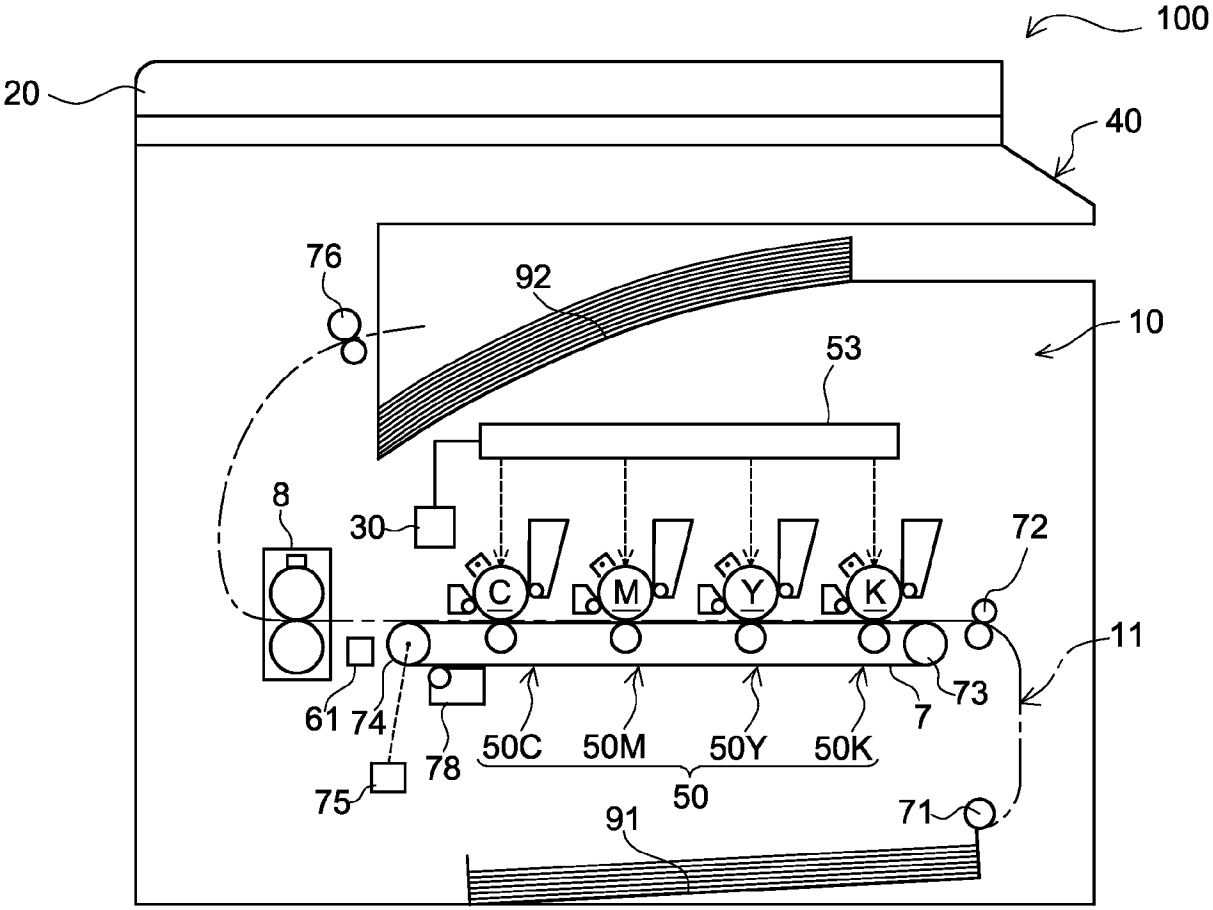
FIG. 2 is a schematic view depicting an internal structure of an image forming portion of the multifunction peripheral device of FIG. 1 in the embodiment according to one or more aspects of the invention.

An internal structure of image forming portion 10 of MFP 100 now is described with reference to FIG. 2. Image forming portion 10 may comprise a process portion 50, a fixing unit 8, a sheet feed tray 91, and a sheet discharge tray 92. Process portion 50 may form a toner image by an electrophotographic method and may transfer the toner image onto a sheet. Fixing unit 8 may fix the transferred toner onto the sheet. Sheet feet tray 91 may hold therein sheets to which images have not been transferred. Sheet discharge tray 92 may hold sheets on which images have been transferred. An image reading portion 20 may be disposed above image forming portion 10.

Process portion 50 may comprise process units 50C, 50M, 50Y, 50K. Image forming portion 10 may comprise an exposure unit 53, a conveyor belt 7, and a sensor 61, such as an optical sensor. Exposure unit 53 may irradiate each process unit 50C, 50M, 50Y, 50K with light. Conveyor belt 7 may convey a sheet to a transfer position of each process unit 50C, 50M, 50Y, 50K. Sensor 61 may detect a mark formed on conveyor belt 7.

A substantially S-shaped conveying path 11 (indicated by a dot and dashed line in FIG. 2) may be provided in image forming portion 10, such that a sheet, which may be loaded on sheet feed tray 91 at the bottom of image forming portion 10, may be guided to sheet discharge tray 92 through a sheet feed roller 71, a registration roller 72, process portion 50, fixing unit 8, and a discharge roller 76.

Process units 50C, 50M, 50Y, 50K may correspond to respective colors of cyan C, magenta M, yellow Y, and black K. Accordingly, process portion 50 may form an image in color. In process portion 50, process units 50C, 50M, 50Y, 50K may be disposed in parallel with each other. Specifically, process unit 50C may form an image in cyan C, process unit 50M may form an image in magenta M, process unit 50Y may form an image in yellow Y, and process unit 50K may form an image in black K. Process units 50C, 50M, 50Y, 50K may be separated from each other at a predetermined distance in a sheet-conveying direction.

Figure 3:
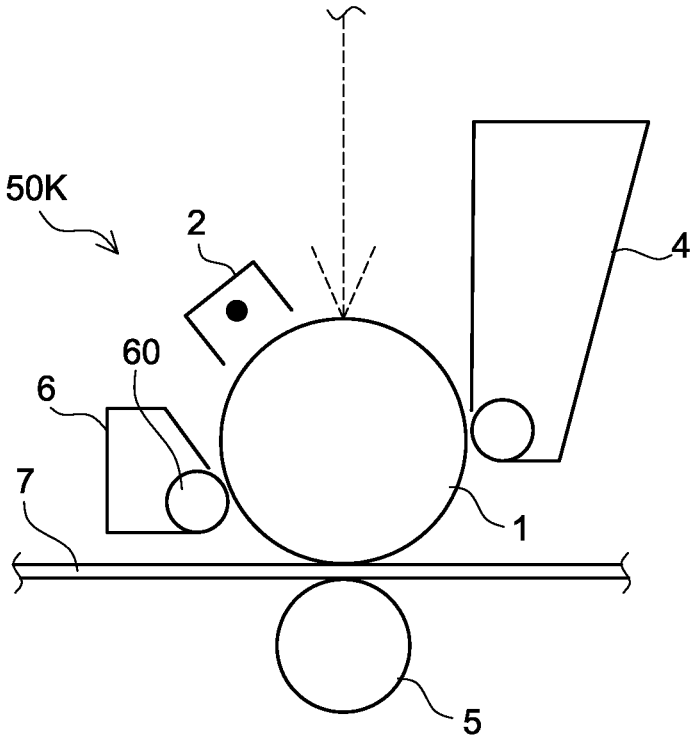
FIG. 3 is a schematic view depicting an internal structure of a process unit of the multifunction peripheral device of FIG. 1 in the embodiment according to one or more aspects of the invention.

A structure of process unit 50K now is described with reference to FIG. 3. Process unit 50K may comprise a drum-shaped photosensitive member 1, a charger 2, a developing unit 4, a transfer unit 5, and a cleaner 6. Charger 2 may uniformly charge a surface of photosensitive member 1. Developing unit 4 may develop an electrostatic latent image by using toner. Transfer unit 5 may transfer a toner image formed on photosensitive member 1 onto a sheet. Cleaner 6 may electrically catch toner remaining on photosensitive member 1 after transfer unit 5 transfers a toner image onto the sheet from the surface of photosensitive member 1 (e.g., the toner remaining on photosensitive member 1 after transfer unit 5 transfers a toner image is referred to as "transfer residual toner"). Photosensitive member 1 and transfer unit 5 may be in contact with conveyor belt 7 and may be disposed on opposite sides of conveyor belt 7 while sandwiching conveyor belt 7 therebetween. Process units 50C, 50M, 50Y may have the same structure as process unit 50K described above.

In each process unit 50C, 50M, 50Y, 50K, the surface of photosensitive member 1 may be charged uniformly by charger 2. Then, the surface of photosensitive member 1 then may be exposed to light from exposure unit 53. In this manner, an electrostatic latent image of an image to be formed on a sheet may be formed on the surface of photosensitive member 1. After that, developing unit 4 may supply toner to photosensitive member 1. Thus, the electrostatic latent image formed on photosensitive member 1 may become a toner image.

In image forming portion 10, sheet feed roller 71 may pick up a sheet loaded in sheet feed tray 91 and may convey the sheet to registration roller 72. Registration roller 72 may convey the sheet onto conveyor belt 7. Then, transfer unit 5 may transfer a toner image formed in process portion 50 onto the sheet. In a color printing process, each process unit 50C, 50M, 50Y, 50K may form a toner image, and the formed toner images may overlap on the sheet when transferred to form the color image. In a monochrome printing process, process unit 50K alone may form a toner image which transfer unit 5 may transfer onto the sheet. After transfer unit 5 transfers the toner image onto the sheet, conveyor belt 7 may convey the sheet to fixing unit 8. Fixing unit 8 thermally may fix the color or monochrome toner image onto the sheet. Then, the sheet having the fixed toner image may be discharged onto sheet discharge tray 92.

Conveyor belt 7 may be an endless belt member wound around conveyor rollers 73, 74 (See FIG. 2) and may be made of resin material, e.g., polycarbonate. Conveyor roller 73 may be urged in a direction that separates from conveyor roller 74. With this structure, conveyor rollers 73, 74 may hold conveyor belt 7 via tension.

Conveyor roller 74 may be a drive roller that is driven by a drive motor 75. Conveyor belt 7 may rotate in a counterclockwise direction in FIG. 2 when conveyor roller 74 rotates. With this rotation, conveyor belt 7 may convey a sheet placed on a surface thereof from registration roller 72 to fixing unit 8. Conveyor roller 73 may rotate by following the rotation of conveyor belt 7.

A waste-toner box 78 may be disposed in contact with conveyor belt 7 to collect toner adhering to conveyor belt 7. Waste-toner box 78 may collect toner used for images and various observations, as described below; and waste-toner box 78 may collect transfer residual toner discharged from cleaners 6 of process units 50C, 50M, 50Y, 50K.

Sensor 61 may be disposed downstream of process units 50C, 50M, 50Y, 50K and upstream of waste-toner box 78 in the sheet-conveying direction. Sensor 61 may detect marks that are formed by process units 50C, 50M, 50Y, 50K and that are transferred onto conveyor belt 7.

Figure 4:
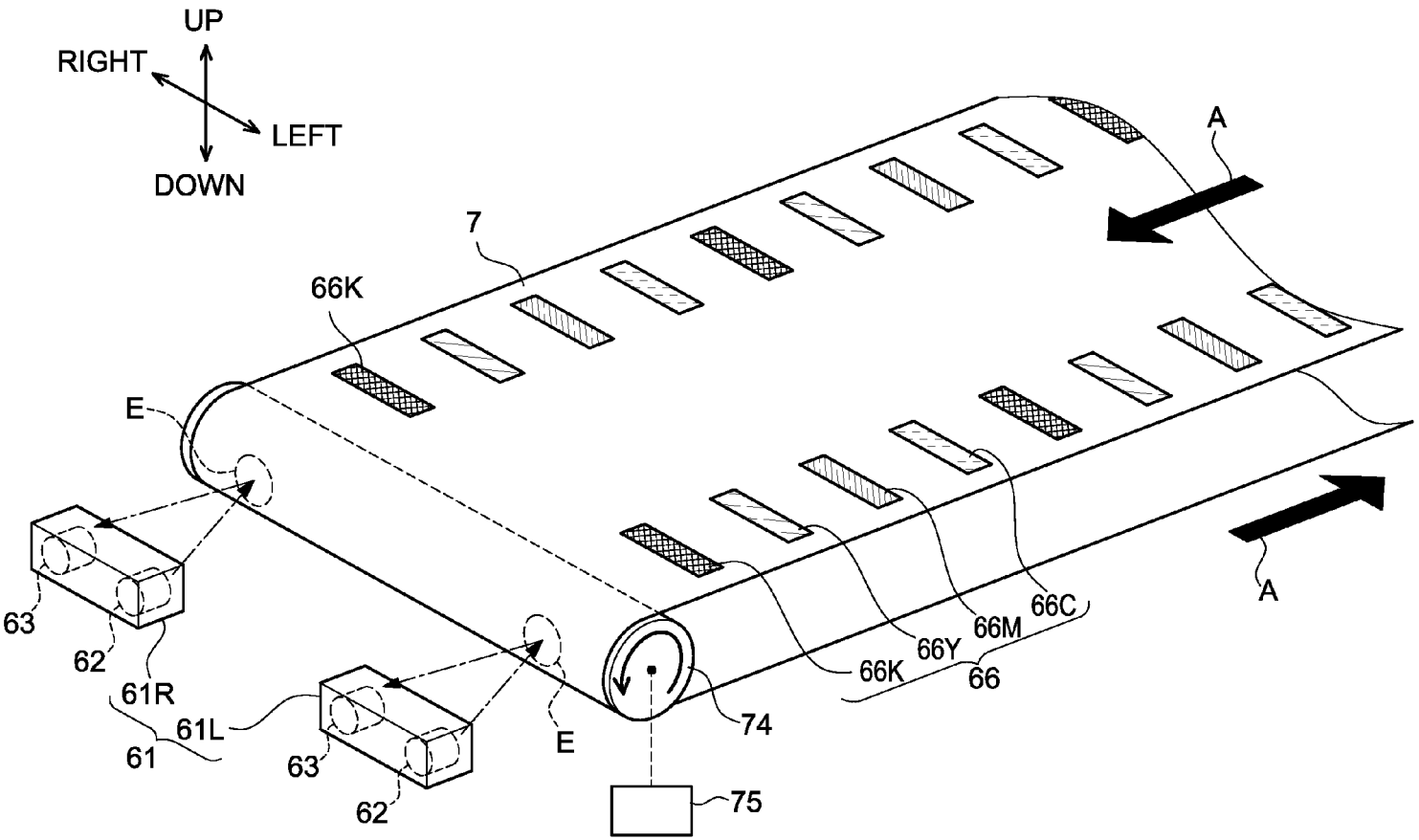
FIG. 4 depicts an exemplary arrangement of sensors in the embodiment according to one or more aspects of the invention.

More specifically, as depicted in FIG. 4, sensor 61 may comprise a plurality of, e.g., two, sensors 61R, 61L arranged side by side in a width direction of conveyor belt 7. Sensor 61R may be disposed at a right side of conveyor belt 7 in the width direction, and sensor 61L may be disposed at a left side of conveyor belt 7 in the width direction. Each of sensors 61R, 61L may be a reflection type optical sensor, and each of sensors 61R, 61L may comprise a light-emitting element 62, e.g., a light-emitting diode (LED), and a light receiving element 63, e.g., a phototransistor. In each sensor 61R, 61L, light-emitting element 62 may irradiate the surface of conveyor belt 7 (e.g., an area E indicated by a dashed line in FIG. 4) with light from an oblique direction, and light receiving element 63 may receive the light reflected from the surface of conveyor belt 7.

A mark 66 may comprise a group of marks 66C, 66M, 66Y, 66K, which respective process units 50C, 50M, 50Y, 50K may form and which transfer unit 5 may transfer onto conveyor belt 7. Referring to FIG. 4, conveyor belt 7 may convey mark 66 in a conveying direction indicated by an arrow A as conveyor belt 7 rotates. Sensor 61 may detect mark 66 based on a difference between an amount of received light reflected from mark 66 formed on the surface of conveyor belt 7 and an amount of received light directly reflected from the surface of conveyor belt 7.

Figure 5:
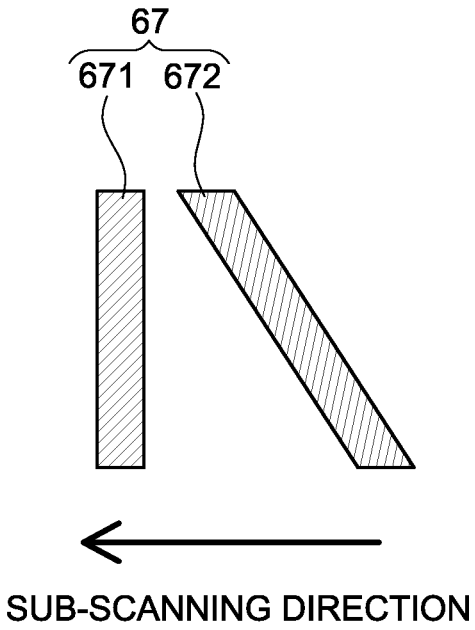
FIG. 5 depicts an exemplary mark for positional deviation adjustment in the embodiment according to one or more aspects of the invention.

An orientation, a shape, a size, or a toner density of mark 66 may differ based on a reason for detecting mark 66. For example, as depicted in FIG. 5, a mark 67 for positional deviation adjustment may comprise a pair of strip-shaped marks 671, 672, in which strip-shaped mark 671 may extend in a belt-width direction (i.e., a left-right direction as depicted in FIG. 4) perpendicular to the conveying direction, and strip-shaped mark 672 may be inclined by a predetermined angle with respect to the belt-width direction. Controller 30 may use readings from sensor 61 based on mark 67 for positional deviation adjustment to determine an amount of positional deviation of mark 67 in the belt-width direction. In particular, controller 30 may determine an elapsed detection period (i.e., an actual detection period) between a first time when sensor 61 detects strip-shaped mark 671 and a second time when sensor 61 detects strip-shaped mark 672. Controller 30 then may determine a lag time by determining a difference between the elapsed detection period and a reference detection period, wherein the reference detection period may be an actual detection period between a first time when sensor 61 detects strip-shaped mark 671 and a second time when sensor 61 detects strip-shaped mark 672, in which mark 67 is formed without a positional deviation of mark 67 in the belt-width direction.

Specifically, when mark 67 is formed with a positional deviation in the belt-width direction, the time period between detecting strip-shaped mark 671 in detection area E and detecting strip-shaped mark 672 in detection area E may be different than when mark 67 is formed without a positional deviation in the belt-width direction. Thus, the elapsed detection period may be different from the reference detection period, and controller 30 may use the difference between the elapsed detection period and the reference detection period to determine the amount of positional deviation of mark 67 in the belt-width direction.

In addition, controller 30 may determine an amount of positional deviation between marks corresponding to process units 50C, 50M, 50Y, 50K in the conveying direction. In particular, controller 30 may determine an elapsed detection period (i.e., an actual detection period) between a first time when sensor 61 detects strip-shaped mark 671 corresponding to a first color and a second time when sensor 61 detects strip-shaped member 671 corresponding to a second color. Controller 30 then may determine a lag time by determining a difference between the elapsed detection period and a reference detection period, wherein the reference detection period may be an actual detection period between a first time when sensor 61 detects strip-shaped mark 671 of the first color and a second time when sensor 61 detects strip-shaped mark 671 of the second color in which strip-shaped mark 671 of the first color and strip-shaped mark 671 of the second color is formed without a positional deviation between corresponding process units 50 in the conveying direction. Thus, the elapsed detection period may be different from the reference detection period, and controller 30 may use the difference between the elapsed detection period and the reference detection period to determine the amount of positional deviation between marks corresponding process units 50C, 50M, 50Y, 50K in the conveying direction.

Figure 6:
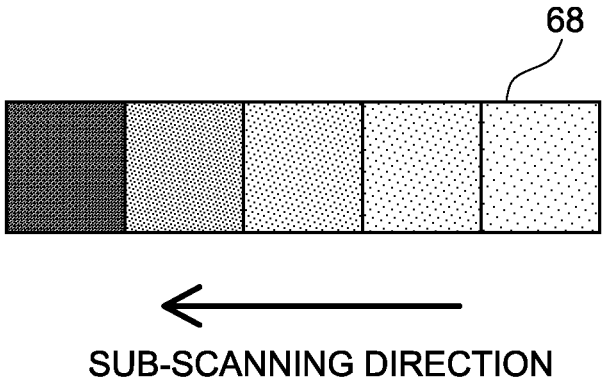
FIG. 6 depicts an exemplary mark for developer-density deviation adjustment in the embodiment according to one or more aspects of the invention.

As depicted in FIG. 6, a mark 68 for toner-density deviation adjustment may have different densities of toner therein along the conveying direction. Sensor 61 may detect an amount of light reflected from mark 68 and may identify each different toner density based on the amount of reflected light as conveyor belt 7 conveys mark 68 for toner-density deviation adjustment.

Hereinafter, a cleaning operation of MFP 100 is described. In MFP 100, transfer residual toner may be collected by a procedure which is described below.

In each process unit 50C, 50M, 50Y, 50K, after transfer unit 5 transfers a toner image held by photosensitive member 1 onto a transfer member, e.g., a sheet or conveyor belt 7, cleaner 6 temporarily may collect transfer residual toner remaining on the surface of photosensitive member 1. Cleaner 6 may comprise a cleaning roller 60 that may be in contact with photosensitive member 1 as depicted in FIG. 3. Cleaner 6 may catch the transfer residual toner remaining on the surface of photosensitive member 1 by electrically catching the transfer residual toner remaining on the surface of photosensitive member 1 using a catching bias applied to cleaning roller 60.

Cleaner 6 then may provide the caught toner back to photosensitive member 1 at a predetermined timing, e.g., a timing when the predetermined number of pages are printed, when image forming portion 10 is not forming an image. Thus, a discharging bias, which has a polarity reverse to the catching bias, may be applied to cleaning roller 60 to discharge the caught toner onto the surface of photosensitive member 1 from cleaner 6.

Figure 7:
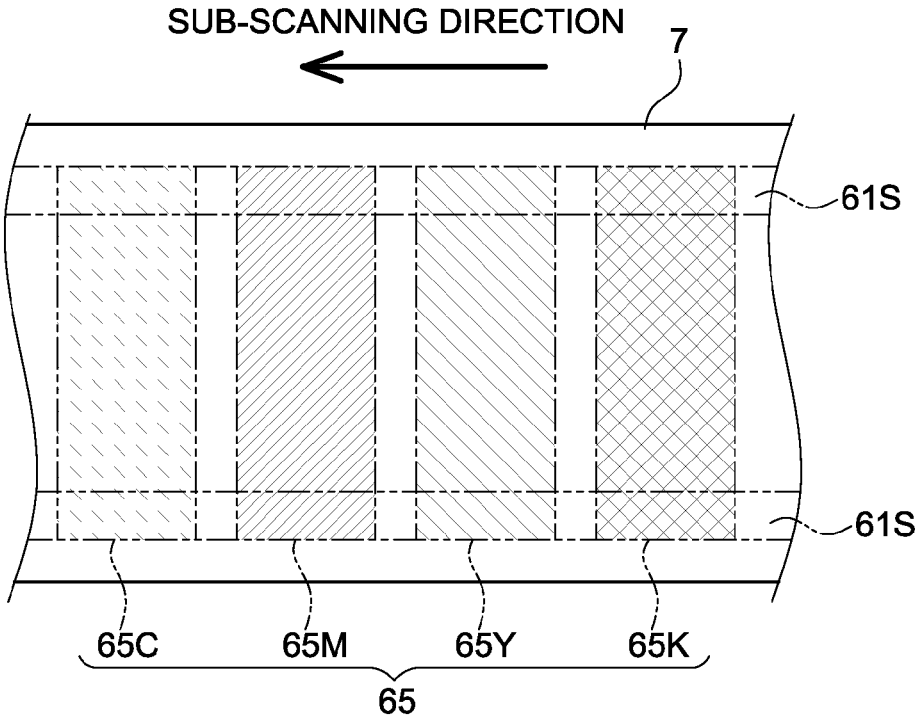
FIG. 7 depicts transfer residual toner that may be transferred onto a transfer belt after discharge from a cleaner in the embodiment according to one or more aspects of the invention.

After that, photosensitive member 1 may convey, via rotation, the transfer residual toner provided from cleaner 6, and transfer unit 5 may transfer the transfer residual toner provided from cleaner 6 onto conveyor belt 7. FIG. 7 depicts a toner area 65 formed by the transfer residual toner of each color transferred onto conveyor belt 7 from photosensitive member 1. Toner area 65 may comprise a cyan toner area 65C, a magenta toner area 65M, a yellow toner area 65Y, and a black toner area 65K. The cleaning operation may start and end at the same time in all of process units 50C, 50M, 50Y, 50K. Therefore, toner areas 65C, 65M, 65Y, 65K formed by the transfer residual toner discharged from respective process unit 50C, 50M, 50Y, 50K may have the same width. A time period over which each cleaner 6 discharges the transfer residual toner may be determined, such that toner areas 65C, 65M, 65Y, 65K formed by the transfer residual toner may not become mixed with or overlap each other. Accordingly, toner areas 65C, 65M, 65Y, 65K may be formed on conveyor belt 7 at a distance from each other.

Conveyor belt 7 may convey, via rotation, the transfer residual toner transferred onto conveyor belt 7 to waste-toner box 78, and waste-toner box 78 may collect the transfer residual toner from conveyor belt 7. The structure of waste-toner box 78 is not limited to the specific embodiment of the invention. Waste-toner box 78 may have other structures and configurations for collecting matter adhered to conveyor belt 7. For example, waste-toner box 78 may collect matter adhering to conveyor belt 7 by using a mechanical collecting method, e.g., using a blade, by using an electrical collecting method, e.g., using cleaner 6, or by using a combination of these or other methods.

Figure 8:
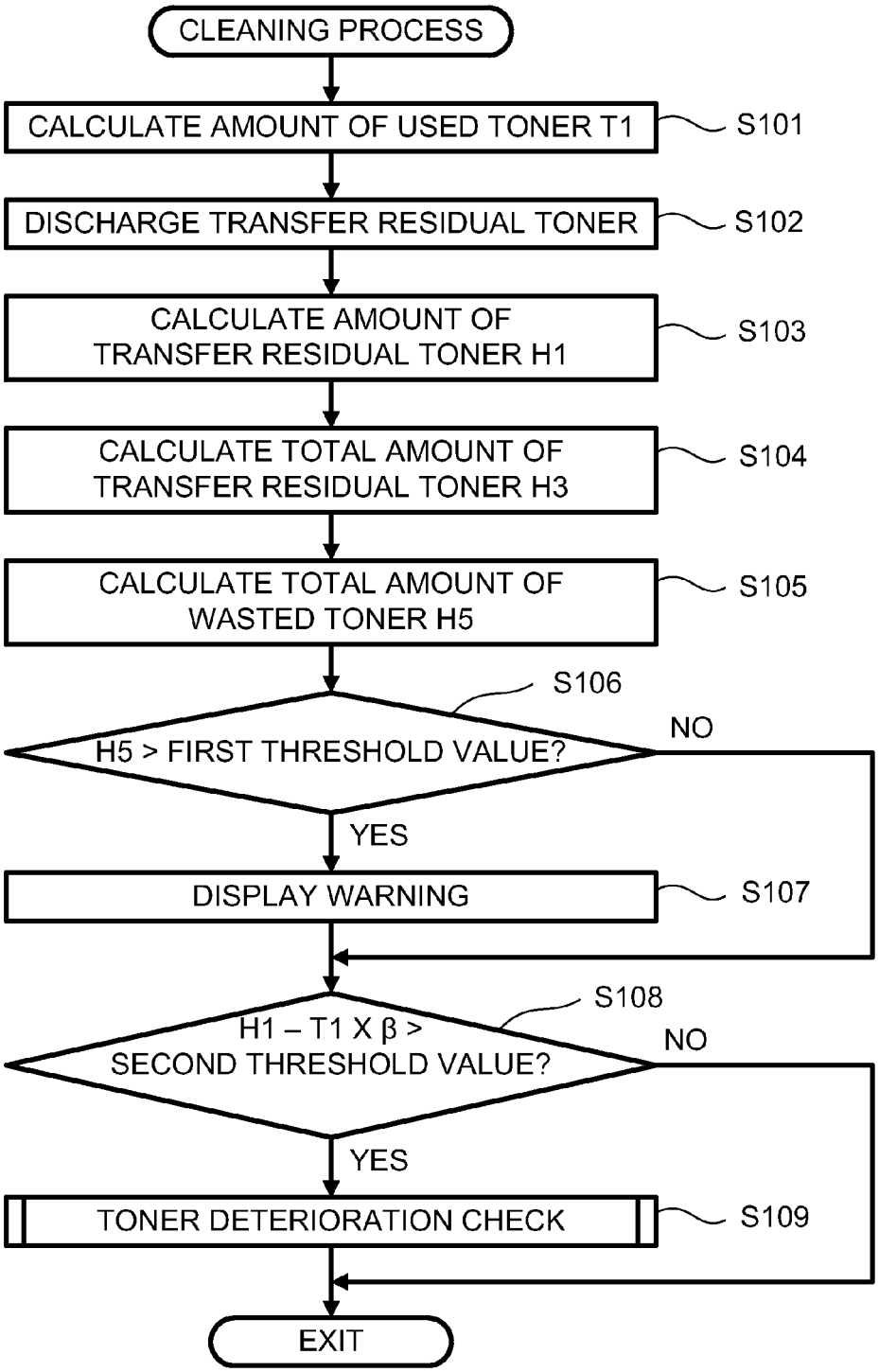
FIG. 8 is a flowchart depicting a cleaning process in the embodiment according to one or more aspects of the invention.

The cleaning process for implementing the above-described cleaning operation now is described with reference to FIG. 8. CPU 31 may initiate the cleaning process when predetermined criteria are met. The predetermined criteria may be, for example, that the power of MFP 100 is turned on, that the number of pages printed from the previous cleaning process is greater than or equal to a threshold value, that a time elapsed from the previous cleaning process is greater than or equal to a threshold value, that an amount of toner used from the previous cleaning process is greater than or equal to a threshold value, or that an instruction is input.

In the cleaning process, first, an amount of toner used in areas detected by sensor 61, e.g., sensed areas 61S depicted in FIG. 7, in each process unit 50C, 50M, 50Y, 50K from the previous cleaning process (i.e., an amount of used toner T1), may be calculated (step S101). Thus, CPU 31 may calculate the amount of used toner T1, i.e., the amount of toner that has been adhered to the surface of photosensitive member 1, based on the amount of toner adhered to sensed areas 61S of sensor 61 after the previous cleaning process. More specifically, in MFP 100, NVRAM 34 may store a duty ratio (e.g., a percentage of dots in a printed area) every time MFP 100 performs a printing process. The amount of used toner T1 on the surface of photosensitive member 1, based on the amount of toner adhered to sensed areas 61S, may be calculated using Expression 1 below. In Expression 1, "N" may represent the number of pages printed from the previous cleaning process, and "a" may represent the amount of toner used at a duty ratio of 1%.

$$T1 = N \times \text{Average of duty ratios of sensed areas} \times \alpha \qquad \text{Expression 1}$$

The transfer residual toner temporarily caught by cleaner 6 next may be discharged onto the surface of photosensitive member 1 (step S102). The discharge of the transfer residual toner may start and end at the same time in all of process units 50C, 50M, 50Y, 50K. Process units 50C, 50M, 50Y, 50K may discharge the transfer residual toner of colors cyan C, magenta M, yellow Y, and black K onto respective photosensitive members 1, and transfer unit 5 then may transfer the transfer residual toner of colors cyan C, magenta M, yellow Y, and black K onto conveyor belt 7.

Then, sensor 61 may detect the transfer residual toner transferred onto conveyor belt 7, and CPU 31 may calculate an amount of transfer residual toner actually existing in sensed areas 61S of toner area 65 on conveyor belt 7 (i.e., an amount of transfer residual toner H1 for each color toner (step S103). More specifically, sensor 61 may detect the amount of light reflected from each of toner areas 65C, 65M, 65Y, 65K. CPU 31 then may determine the toner density based on the amount of reflected light, and CPU 31 may calculate the amount of transfer residual toner H1 for each color toner based on the obtained toner density. Because toner areas 65C, 65M, 65Y, 65K may be conveyed one after another in the order in which process units 50C, 50M, 50Y, 50K are arranged above conveyor belt 7, sensor 61 may identify the color of transfer residual toner currently measured by the arrangement order of process units 50C, 50M, 50Y, 50K. For example, sensor 61 may identify which color of transfer residual toner is detected by using an elapsed time period since sensor 61 detected a first toner area. More specifically, sensor 61 may detect transfer residual toner of cyan during a lapse of about 1 to 3 seconds, transfer residual toner of magenta during a lapse of about 4 to 6 seconds, transfer residual toner of yellow during a lapse of about 7 to 9 seconds, and transfer residual toner of black during a lapse of about 10 to 12 seconds since sensor 61 detected the first toner area. Nevertheless, the above-described elapsed time periods and arrangement order are merely exemplary, and the invention is not limited to these elapsed times or arrangement orders.

CPU 31 next may calculate a total amount of transfer residual toner discharged onto conveyor belt 7 (i.e., a total amount of transfer residual toner H3) for each color toner (step S104). More specifically, in MFP 100, CPU 31 may calculate a percentage of transfer residual toner in sensed areas 61S (e.g., the amount of transfer residual toner H1 divided by the amount of used toner T1). Based on the obtained percentage of transfer residual toner in sensed areas 61S, CPU 31 then may calculate an amount of transfer residual toner in an area other than sensed areas 61S (i.e., an amount of transfer residual toner in the unsensed area H2). Thus, CPU 31 may obtain the total amount of transfer residual toner H3 on a toner area basis by adding the amount of transfer residual toner H1 in sensed areas 61S to the amount of transfer residual toner H2 in unsensed area.

CPU 31 then may calculate a total amount of transfer residual toner collected in waste-toner box 78 (i.e., a total amount of wasted toner H5) (step S105). More specifically, in MFP 100, CPU 31 may calculate the total amount of wasted toner H5 using Expression 2 below. In Expression 2, "H4" may represent a previous total amount of wasted toner. The new total amount of wasted toner H5 may be stored in NVRAM 34 and may become the previous total amount of wasted toner H4 in the next cleaning process.

$$H5=H4+H3 \text{ of four colors} \qquad \text{Expression 2}$$

CPU 31 then may determine whether the total amount of wasted toner H5 is greater than a first threshold value (step S106). Thus, CPU 31 may determine whether waste-toner box 78 is almost full of toner. If the total amount of wasted toner H5 is greater than the first threshold value (step S106: YES), operating panel 40 may display a message indicating that waste-toner box 78 is almost full of toner or that waste-toner box 78 needs to be changed (step S107).

After step S107 or when the total amount of wasted toner H5 is less than or equal to the first threshold value (step S106:NO), CPU 31 may determine whether toner is deteriorated. More specifically, it is determined whether Expression 3 is satisfied.

$$H1-T1\times\beta>\text{Second threshold value} \qquad \text{Expression 3}$$

In Expression 3, "β" may represent an ideal transfer rate. That is, Expression 3 means that an allowable amount of transfer residual toner is greater than the second threshold value. The allowable amount of transfer residual toner may be determined by determining an ideal amount of transfer residual toner and reducing the ideal amount of transfer residual toner based on the ideal transfer rate from an actual amount of transfer residual toner. If toner is deteriorated, it may be difficult to control charging of the toner. This may cause an increase in the allowable amount of transfer residual toner calculated by Expression 3. Therefore, when the allowable amount of transfer residual toner increases to a value greater than the second threshold, toner deterioration may be suspected. The amount of transfer residual toner H1 may vary depending on the amount of toner actually used for printing images. Accordingly, the criteria for determining whether toner is deteriorated also may comprise the amount of used toner T1.

When Expression 3 is not satisfied (step S108:NO), CPU 31 may determine that the toner is not deteriorated and the cleaning process ends. When Expression 3 is satisfied (step S108:YES), i.e., when the difference between the actual amount of transfer residual toner and the amount of transfer residual toner obtained from the ideal transfer rate is greater than the second threshold value (step S108:YES), toner deterioration may be suspected. Controller 30 then may perform a toner deterioration check process to check a level of the toner deterioration in detail (step S109).

Figure 9:
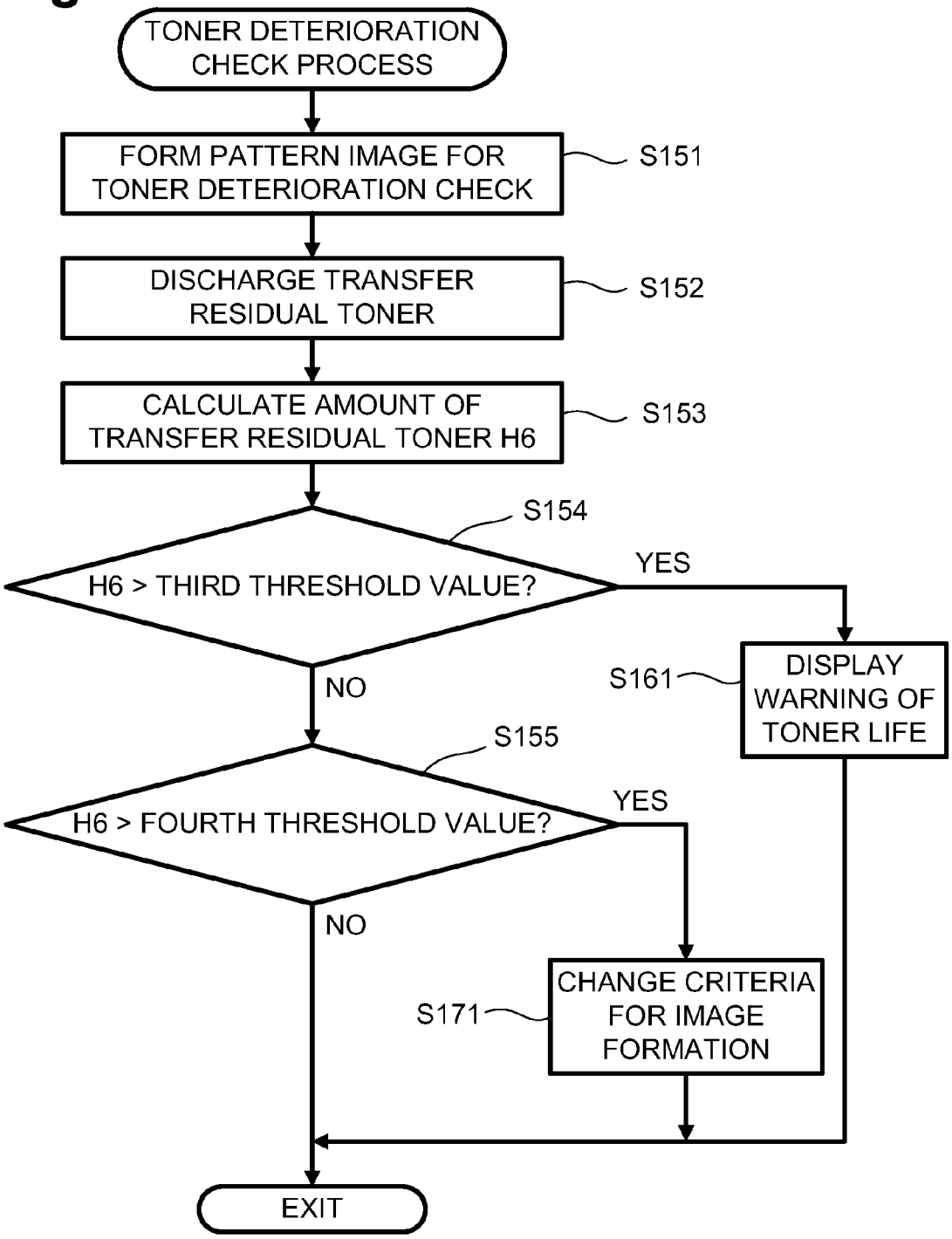
FIG. 9 is a flowchart depicting a toner deterioration check process.
Figure 10A:
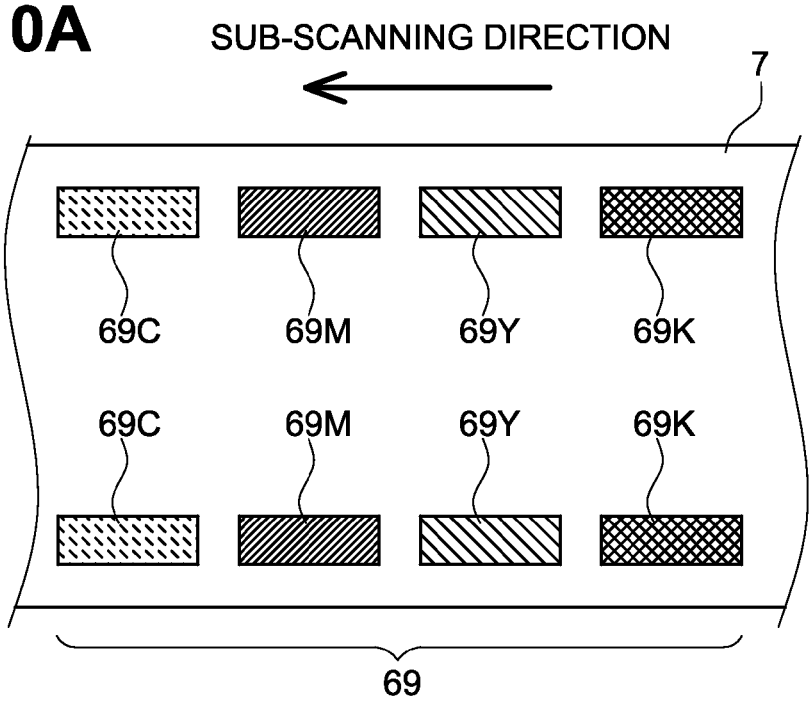
FIGS. 10A and 10B depict pattern images for toner deterioration check process.

The toner deterioration check process (step S109) now is described with reference to FIG. 9. First, process units 50 may form a pattern image for toner deterioration check 69, and transfer unit 5 may transfer pattern image for toner deterioration check 69 onto conveyor belt 7 (step S151). In the described embodiment, pattern image for toner deterioration check 69 may be formed as solid images 69C, 69M, 69Y, 69K in sensed areas 61S, as depicted in FIG. 10A. Process units 50C, 50M, 50Y, 50K may form solid images 69C, 69M, 69Y, 69K, respectively, such that solid images 69C, 69M, 69Y, 69K do not overlap each other.

Waste-toner box 78 may collect pattern image for toner deterioration check 69 formed on conveyor belt 7. The amount of toner used for pattern image for toner deterioration check 69 also may be added to the last total amount of wasted toner H4. Toner used to form pattern image for toner deterioration check 69 that is not transferred onto conveyor belt 7 may remain on photosensitive member 1 as transfer residual toner, and the transfer residual toner may be caught by cleaner 6. Cleaner 6 may discharge the transfer residual toner therefrom at step S102. Therefore, most of the transfer residual toner caught in cleaner 6 may be transfer residual toner of pattern images for toner deterioration check 69.

Figure 10B:
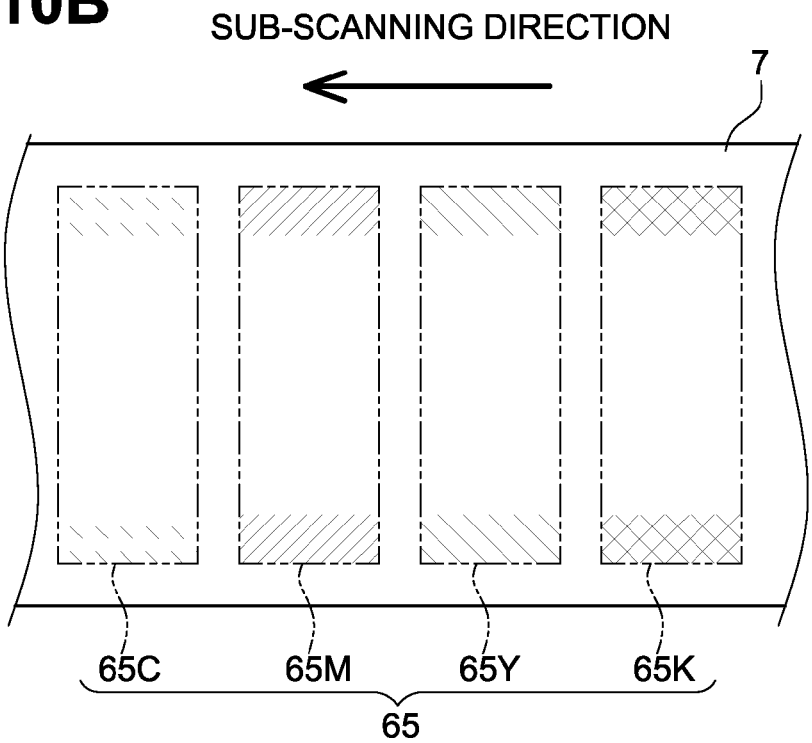

After waste-toner box 78 collects pattern image for toner deterioration check 69, cleaner 6 may discharge the toner caught in cleaner 6 onto the surface of photosensitive member 1 (step S152). The discharge of the transfer residual toner may start and end at the same time in all of process units 50C, 50M, 50Y, 50K. Transfer unit 5 may transfer the discharged transfer residual toner of each color onto conveyor belt 7. At that time, most of the transfer residual toner caught in cleaner 6 may be transfer residual toner of pattern images for toner deterioration check 69. Accordingly, a greater amount of transfer residual toner may be transferred to sensed areas 61S, which correspond to pattern image for toner deterioration check 69 formed at step S151 depicted in FIG. 10B, than to other areas of conveyor belt 7.

After that, sensor 61 may detect the transfer residual toner discharged onto conveyor belt 7, and CPU 31 may calculate an amount of transfer residual toner H6 (step S153). The calculation may be the same as that performed at step S103.

Then, CPU 31 may determine whether the amount of transfer residual toner H6 obtained at step S153 is greater than a third threshold value (step S154). When the amount of transfer residual toner H6 is greater than the third threshold value (step S154:YES), CPU 31 may determine that the toner has reached the end of its life. Therefore, operating panel 40 may display a message indicating that the toner has reached the end of its life and that the toner cartridge needs to be changed is displayed on (step S161).

When the amount of transfer residual toner H6 is less than or equal to the third threshold value (step S154:NO), CPU 31 may determine whether the amount of transfer residual toner H6 is greater than a fourth threshold value (step S155). The fourth threshold value may be less than the third threshold value. Thus, CPU 31 may determine whether the amount of transfer residual toner is greater than desired although the toner has not reached the end of its life. When the amount of transfer residual toner H6 is greater than the fourth threshold value (step S155:YES), CPU 31 may change the operation of the image formation process to reduce the amount of toner that becomes transfer residual toner (step S171). For example, a developing bias or a transfer bias may be increased or the exposure intensity may be increased such that the toner moves more easily. By doing so, degradation in images may be prevented.

When the amount of transfer residual toner H6 is less than or equal to the fourth threshold value (step S155:NO), CPU 31 may determine that the toner is not deteriorated. Therefore, the toner deterioration check process may end without changing the operation of the image formation process. After processing of step S161 or step S171, the toner deterioration check process may end. After the toner deterioration check process, the cleaning process of FIG. 8 also may end.

As described above, in MFP 100 according to the embodiment, sensor 61 may measure the amount of transfer residual toner that cleaner 6 discharged and that waste-toner box 78 has not yet collected. By doing so, MFP 100 may identify a condition of the transfer residual toner. As a result, for example, the toner deterioration, the toner life, or the amount of toner stored in waste-toner box 78 may be readily determined.

Although the invention may be applied to MFP 100 having the color printing function, the image forming apparatus is not limited to the color printing apparatus. For example, the invention may be applied to a monochrome printing apparatus comprising a single process unit.

In the embodiment described above, CPU 31 may determine whether waste-toner box 78 is full of toner based on the total amount of wasted toner H5 at step S106. The total amount of wasted toner H5 may be an estimated value of the amount of transfer residual toner in an entire area of the toner area of each color toner based on the amount of transfer residual toner H1 in sensed areas 61S. Thus, the estimated value may not coincide with the actual amount of transfer residual toner. Therefore, the first threshold value may be set to be less than the actual full amount. In addition, a sensor may be provided in waste-toner box 78 for optically detecting that waste-toner box 78 is full of toner. When the sensor detects that waste-toner box 78 is full of toner, CPU 31 may prohibit the image formation process until waste-toner box 78 is exchanged with empty one.

In the embodiment described above at step S108, CPU 31 may determine whether the toner is deteriorated based on a criteria that the difference between the actual amount of transfer residual toner and the ideal amount of transfer residual toner is greater than the second threshold value. Nevertheless, the determination as to whether toner is deteriorated may be made based on other criteria. For example, the criteria may be that the ratio between the amount of used toner T1 and the amount of transfer residual toner H1 (i.e., T1/H1) is greater than a predetermined threshold value.

In the embodiment described above, after the determination step of step S108, a pattern image for toner deterioration check 69 may be newly formed and the toner condition may be checked in detail. Nevertheless, a message indicating the toner status may be displayed or criteria for image formation may be changed without performing the toner deterioration check process of step S109. Thus, both of the message indicating the toner status may be displayed and the criteria for image formation may be changed without performing the toner deterioration check process of step S109.

In the embodiment described above, the process in which CPU 31 may determine the toner deterioration level in detail by using a special pattern image 69 may be performed when toner deterioration is suspected. Nevertheless, the criteria for performing the process to determine the toner deterioration level in detail by using a special pattern image 69 is not limited to a state where the toner deterioration is suspected. For example, the criteria for performing the process may be that an amount of toner used from the previous cleaning process becomes greater than or equal to a threshold value.

In the embodiment described above, a special pattern image 69 may be formed to determine the toner deterioration level in detail. Nevertheless, special pattern image 69 may not be used. For example, mark 67 for positional deviation adjustment, or another similar mark, may be used to determine the toner deterioration level.

In the embodiment described above, CPU 31 may determine a status of the toner life and may change the criteria for image formation as part of the toner deterioration check process. Nevertheless, both the determination of the status of toner life and the change of the image formation criteria may not be required. Thus, one of the determination of the status of toner life and the change of the image formation criteria may be performed. For example, a pattern image 69 may be formed for determining whether the image formation criteria have changed.

In the embodiment described above, the sensor, which may detect the amount of transfer residual toner in the cleaning process, also may serve as the sensor for adjusting the positional deviation and the toner density. A special sensor dedicated to the positional deviation adjustment and the toner-density adjustment may be provided. In this case, the special sensor may detect not only the end portions, but also an entire area of conveyor belt 7 in the width direction. Further, in this case, a pattern image for toner deterioration check 69 may be a solid image formed in the entire area of conveyor belt 7 in the width direction.

While the invention has been described in connection with various example structures and illustrative embodiments, it will be understood by those skilled in the art that other variations and modifications of the structures and embodiments described above may be made without departing from the scope of the invention. For example, the image forming apparatus may be applied to many devices having a printing function, e.g., printers, copying machines, facsimile machines, as well as to the multifunction peripheral device. Although MFP 100 of the embodiment may be a tandem image forming apparatus using a direct transfer method, for example, an image forming apparatus using an intermediate transfer method or four cycle method may be used. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. An image forming apparatus comprising:

a conveyor member;

a process unit comprising:

a photosensitive member;

an image forming portion configured to form a developer image with a developer on the photosensitive member;

a transfer member configured to transfer the developer image formed on the photosensitive member onto the conveyor member, wherein the developer remaining on the photosensitive member after transferring the developer image from the photosensitive member is transfer residual developer; and a catching portion configured to catch the transfer residual developer from the photosensitive member, wherein the catching portion is configured to return the transfer residual developer caught by the catching portion to the photosensitive member, and wherein the transfer member is configured to transfer the transfer residual developer returned to the photosensitive member from the catching portion onto the conveyor member; and a controller configured to:

determine whether the transfer residual developer is present or absent on a surface of the conveyor member using a sensor; and change an image formation criteria based on the presence or absence of the transfer residual developer on the surface of the conveyor member determined by the controller, wherein the image formation criteria comprises at least one of:

an amount of bias applied to the developer for forming the developer image, an amount of bias applied to the transfer member for transfer of the developer image, and an exposure intensity of light irradiated on the photosensitive member.

2. The image forming apparatus according to claim 1, wherein the controller is configured to determine that the transfer residual developer is present by determining an amount of the transfer residual developer on the surface of the conveyor member using the sensor.

3. The image forming apparatus according to claim 2, wherein the controller is configured to determine a condition of the developer based on the amount of the transfer residual developer on the surface of the conveyor member, and wherein, when the amount of the transfer residual developer on the surface of the conveyor member determined by the controller is greater than a predetermined amount, the controller determines that the condition of the developer is deteriorated.

4. The image forming apparatus according to claim 1, wherein the controller is configured to determine a condition of the developer based on the presence or absence of the transfer residual developer on the surface of the conveyor member.

5. The image forming apparatus according to claim 4, wherein the controller is configured to determine an amount of the developer used for the developer image formed by the image forming portion and the condition of the developer based on the amount of developer used for the developer image formed by the image forming portion and the presence or absence of the transfer residual developer on the surface of the conveyor member determined by the controller.

6. The image forming apparatus according to claim 4, wherein the developer image is a special pattern image and wherein the controller is configured to determine the condition of the developer based on the presence or absence of the transfer residual developer on the surface of the conveyor member determined by the controller when the image forming portion forms the special pattern image.

7. The image forming apparatus according to claim 1, wherein the controller is configured to determine an amount of the developer used for the developer image formed by the image forming portion and to change the image formation criteria based on the amount of developer used for the developer image formed by the image forming portion and the presence or absence of the transfer residual developer on the surface of the conveyor member determined by the controller.

8. The image forming apparatus according to claim 1, wherein the developer image is a special pattern image and wherein the controller is configured to change the image formation criteria based the presence or absence of the transfer residual developer on the surface of the conveyor member determined by the controller when the image forming portion forms the special pattern image.

9. The image forming apparatus according to claim 1, wherein the image forming apparatus further comprises a plurality of the process units, and wherein the controller is configured to control a timing, at which the catching portion of each process unit of the plurality of process units returns the transfer residual developer of the respective process unit, such that the transfer residual developer transferred to the conveyor member from a first process unit of the plurality of process units does not overlap the transfer residual developer of a second process unit of the plurality of process units when the transfer member of the second process unit transfers the transfer residual developer of the second process unit onto the conveyor member.

10. The image forming apparatus according to claim 9, wherein the controller is configured to start and end the timing of the return of the transfer residual developer to the photosensitive member from the catching portion at the same time in each of the process units.

11. The image forming apparatus according to claim 1, wherein the sensor is an optical sensor, wherein the image forming portion is configured to form a mark on the conveyor member, and wherein the optical sensor is configured to detect the mark and the controller is configured to determine at least one of a positional deviation of the conveyor member and a developer-density deviation based on the detected mark.

12. The image forming apparatus according to claim 2, wherein the controller is configured to estimate an amount of transfer residual developer collected by a collecting portion based on the amount of the transfer residual developer on the surface of the conveyor member determined by the controller.

13. An image forming apparatus comprising:

a conveyor member;

a process unit comprising:

a photosensitive member;

an image forming portion configured to form a developer image with a developer on the photosensitive member;

a transfer member configured to transfer the developer image formed on the photosensitive member onto the conveyor member, wherein the developer remaining on the photosensitive member after transferring the developer image from the photosensitive member is transfer residual developer; and a catching portion configured to catch the transfer residual developer from the photosensitive member, wherein the catching portion is configured to return the transfer residual developer caught by the catching portion to the photosensitive member, and wherein the transfer member is configured to transfer the transfer residual developer returned to the photosensitive member from the catching portion onto the conveyor member; and a controller configured to:

determine an amount of the transfer residual developer on a surface of the conveyor member using a sensor; and change an image formation criteria based on the amount of the transfer residual developer on the surface of the conveyor member determined by the controller, wherein the image formation criteria comprises at least one of:

an amount of bias applied to the developer for forming the developer image, an amount of bias applied to the transfer member for transfer of the developer image, and an exposure intensity of light irradiated on the photosensitive member.

14. The image forming apparatus according to claim 13, wherein the controller is configured to determine a condition of the developer based on the amount of the transfer residual developer on the surface of the conveyor member.

15. The image forming apparatus according to claim 13, wherein, when the amount of the transfer residual developer on the surface of the conveyor member determined by the controller is greater than a predetermined amount, the controller determines that a condition of the developer is deteriorated.

16. The image forming apparatus according to claim 13, wherein the controller is configured to estimate an amount of transfer residual developer collected by a collecting portion based on the amount of the transfer residual developer on the surface of the conveyor member determined by the controller.

17. A method for controlling an image forming apparatus comprising a conveyor member, a sensor, and a process unit, the process unit comprising a photosensitive member and a transfer member, the method comprising the steps of:

forming a developer image with a developer on the photosensitive member;

transferring the developer image formed on the photosensitive member onto the conveyor member, wherein the developer remaining on the photosensitive member after transferring the developer image from the photosensitive member is transfer residual developer;

transferring, via the transfer member, the transfer residual developer remaining on the photosensitive member onto the conveyor member;

determining whether the transfer residual developer is present or absent on a surface of the conveyor member using the sensor; and changing an image formation criteria based on the presence or absence of the transfer residual developer on the surface of the conveyor member determined in the determining step, wherein the image formation criteria comprises at least one of:

an amount of bias applied to the developer for forming the developer image, an amount of bias applied to the transfer member for transfer of the developer image, and an exposure intensity of light irradiated on the photosensitive member.

18. The method of claim 17, wherein the process unit further comprises a catching portion and wherein the method further comprises the steps of:

catching the transfer residual developer from the photosensitive member with the catching portion; and returning the transfer residual developer caught by the catching portion to the photosensitive member.

19. An image forming apparatus comprising:

a conveyor member;

a process unit comprising:

a photosensitive member;

an image forming portion configured to form a developer image with a developer on the photosensitive member;

a transfer member configured to transfer the developer image formed on the photosensitive member onto the conveyor member, wherein the developer remaining on the photosensitive member after transferring the developer image from the photosensitive member is transfer residual developer; and a catching portion configured to catch the transfer residual developer from the photosensitive member, wherein the catching portion is configured to return the transfer residual developer caught by the catching portion to the photosensitive member, and wherein the transfer member is configured to transfer the transfer residual developer returned to the photosensitive member from the catching portion onto the conveyor member; and a controller configured to:

determine whether the transfer residual developer is present or absent on a surface of the conveyor member by determining an amount of the transfer residual developer on the surface of the conveyor member using a sensor; and determine a condition of the developer based on the amount of the transfer residual developer on the surface of the conveyor member, wherein, when the amount of the transfer residual developer on the surface of the conveyor member determined by the controller is greater than a predetermined amount, the controller determines that the condition of the developer is deteriorated.

20. An image forming apparatus comprising:

a conveyor member;

a process unit comprising:

a photosensitive member;

an image forming portion configured to form a developer image with a developer on the photosensitive member;

a transfer member configured to transfer the developer image formed on the photosensitive member onto the conveyor member, wherein the developer remaining on the photosensitive member after transferring the developer image from the photosensitive member is transfer residual developer; and a catching portion configured to catch the transfer residual developer from the photosensitive member, wherein the catching portion is configured to return the transfer residual developer caught by the catching portion to the photosensitive member, and wherein the transfer member is configured to transfer the transfer residual developer returned to the photosensitive member from the catching portion onto the conveyor member; and a controller configured to determine an amount of the transfer residual developer on a surface of the conveyor member using a sensor, wherein, when the amount of the transfer residual developer on the surface of the conveyor member determined by the controller is greater than a predetermined amount, the controller determines that a condition of the developer is deteriorated.

21. A method for controlling an image forming apparatus comprising a conveyor member, a sensor, and a process unit, the process unit comprising a photosensitive member, the method comprising the steps of:

forming a developer image with a developer on the photosensitive member;

transferring the developer image formed on the photosensitive member onto the conveyor member, wherein the developer remaining on the photosensitive member after transferring the developer image from the photosensitive member is transfer residual developer;

transferring the transfer residual developer remaining on the photosensitive member onto the conveyor member; and determining whether the transfer residual developer is present or absent on a surface of the conveyor member by determining an amount of the transfer residual developer on the surface of the conveyor member using the sensor; and determining that a condition of the developer is deteriorated when the amount of the transfer residual developer on the surface of the conveyor member is greater than a predetermined amount.

* * * * *